United States Patent [19]

Moone

[11] 4,092,892

[45] June 6, 1978

[54] HOLE FORMING MACHINE

[76] Inventor: Ronald Moone, 11 Butts Hill Rd., Woodley, Reading, Berkshire, England

[21] Appl. No.: 698,295

[22] Filed: Jun. 21, 1976

[30] Foreign Application Priority Data

Jun. 23, 1975 United Kingdom ..... 26621/75
Jul. 9, 1975 United Kingdom ..... 28939/75

[51] Int. Cl.[2] ..... B26D 7/06

[52] U.S. Cl. ..... 83/413; 83/513; 83/519; 234/43

[58] Field of Search ..... 83/410, 413, 513, 519; 234/42, 43, 45

[56] References Cited

U.S. PATENT DOCUMENTS

| | | | |
|---|---|---|---|
| 2,730,173 | 1/1956 | Brescka | 83/413 |
| 2,958,247 | 11/1960 | Levine | 83/413 |
| 3,297,173 | 1/1967 | Schott | 83/410 |
| 3,613,491 | 10/1971 | Kahmann | 83/413 |
| 3,738,569 | 6/1973 | Killaly | 234/43 |

*Primary Examiner*—Donald R. Schran
*Attorney, Agent, or Firm*—Lawrence E. Laubscher

[57] ABSTRACT

The invention relates to a hole forming machine which has two or more punching heads for punching holes in a sheet of metal. The sheet of metal is moved relative to the punching heads in a guide frame to which is attached a stylus. The stylus is swept over a template having a pattern of pilot holes formed therein. By locating the stylus sequentially in the pilot holes and operating the punching heads, the pattern of holes on the template can be mapped on to the sheet of metal. The provision of two or more punching heads substantially reduces positional errors in the punched pattern.

7 Claims, 3 Drawing Figures

HOLE FORMING MACHINE

FIELD OF THE INVENTION

The present invention relates to a hole forming machine, and has particular, but not exclusive, application to hole punching and indenting machines.

BACKGROUND TO THE INVENTION

It is known to provide a hole punching machine which is arranged to punch a pattern of holes in a sheet of material, the pattern corresponding to a pattern of pilot holes in a template. The sheet of material to be punched is placed in a guide frame which is movable relative to a table, and punching apparatus is mounted on the table for punching the sheet, the punched holes being made in a fixed position relative to the table. A stylus is attached to the guide frame, and by moving the frame, the stylus can be located in turn in each of the pilot holes; the punch being operated each time the stylus is located in a pilot hole so as to map the pattern of holes on the template on to the sheet of material.

This known machine has several disadvantages, particularly when used to punch holes in sheets which are several times larger than the template. For example, with a sheet of material which is twice the size of the template, the sheet must be mounted on the guide frame twice to permit a pattern of holes to be reproduced over the whole sheet. Thus, errors in the positions of holes punched in the sheet are likely to occur, and since the sheet must be accurately mounted twice in the guide frame, the manufacturing time is increased. Moreover, the guide frame of the known punching machine suffers from the disadvantage that it unpredictably permits rotation of the sheet to be punched relative to the template during punching, and hence distortions and positional errors in the punched pattern can occur.

BRIEF SUMMARY OF THE INVENTION

It is an object of the invention to provide a hole forming machine which can produce a pattern of holes or indentations in a sheet of material larger than the template but with substantially reduced likelihood of positional error or distortion of the pattern.

It is also an object of the invention to provide a hole forming machine to provide a machine which can punch or indent holes into a sheet of material at a faster rate than the aforementioned known machines.

With a view to fulfilling these objects, the invention provides a hole forming machine for forming holes in a sheet of material, comprising a first and a further hole forming means for producing holes in the sheet at least two spaced apart stations, and guide means for moving the sheet to predetermined positions relative to the stations thereby to permit a pattern of holes to be formed in the sheet.

In a preferred form, the invention provides a hole forming machine for producing a pattern of holes on a sheet of material in accordance with a pattern on a template, comprising a first and a further hole forming means mounted at spaced apart stations on a machine frame, a guide frame for receiving the sheet of material and which is movable relative to the hole forming means, a locating means mounted on the guide frame and for being moved over the template, and means for operating at least one of the hole forming means when the locating means is located in a point in the pattern on the template.

One advantage of the hole forming machine of the invention is that it has many different modes of operation thereby providing a very useful machine tool. A pattern of holes on the template can be mapped by each of said hole forming means on to the sheet of material larger than the template, each hole forming means mapping the pattern on to a different portion of the sheet. In this way, positional errors which would have occurred by removing and re-installing the sheet into the machine are obviated.

The hole forming means can be driven simultaneously or sequentially. If they are driven sequentially, the machine will not require a power supply of a higher rating than would be required for a single hole forming means, whilst if the hole forming means are driven simultaneously, a substantial reduction of manufacturing time is effected. Also, if required, more than one pattern of holes can be included in the template. Means can be provided to discriminate between the patterns and in this way each of the hole forming means can be arranged to map a different one of the patterns on the template on to the sheet of a material.

Hole forming machines of the invention have other advantageous features and modes of operation which are described in more detail hereinafter.

One particular form of hole forming machine of the invention has a guide frame for moving the sheet of material to be punched relative to the template and the hole forming means, the guide frame comprising two sets of parallel bars, one set being slidably mounted on the other in such a manner that the bars of one set are held at a fixed angle with respect to the bars of the other set, holding means for holding a workpiece fast with one of the sets, and means slidably mounting the other set thereof on the machine frame in such a manner that the bars of said other set can only slide longitudinally.

The guide frame has the advantage that any likelihood of the sheet of material rotating relative to the template is substantially reduced. Any flexing of the bars in use of the guide frame will produce a displacement of the sheet of material relative to the template, but such displacement will have substantially no rotary component and will consequently not introduce any abberation into the pattern of holes mapped on to the sheet of material.

BRIEF DESCRIPTION OF THE DRAWINGS

Further features, objects and advantages of the invention will become apparent from the following description of a preferred embodiment of a hole punching machine of the invention and from the accompanying drawings in which.

Figure 1:
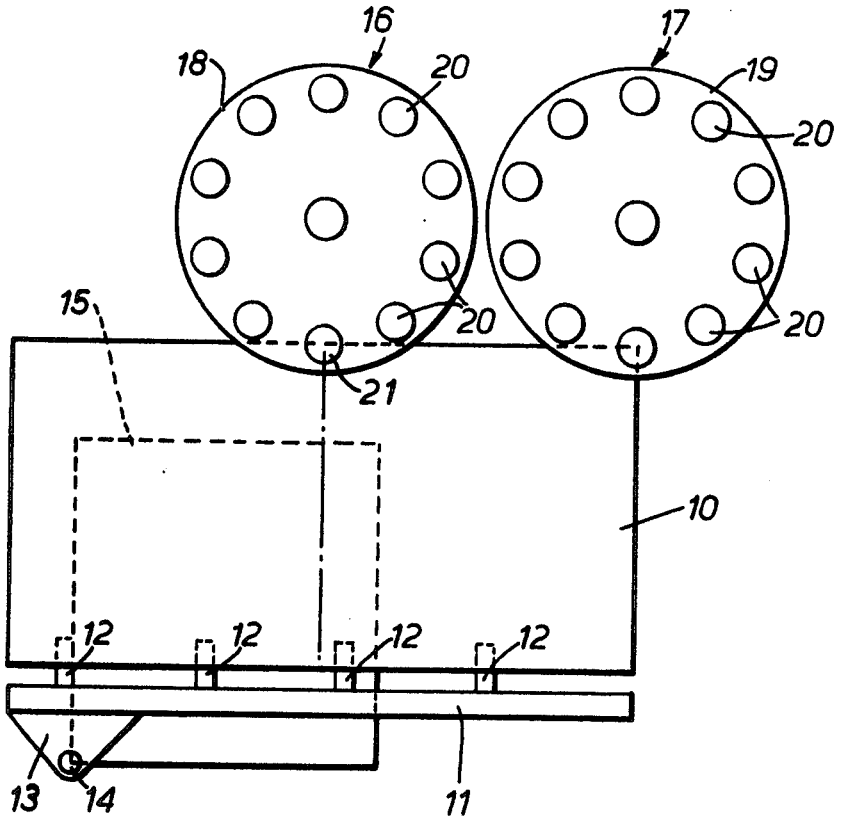
FIG. 1 is a schematic plan view of a hole forming machine of the invention.

Referring firstly to FIG. 1, a sheet of material 10 to be punched is mounted in a guide frame 11 which is movably mounted on a support table on a machine frame (not shown). The support table has a generally horizontal upper surface, the guide frame 11 and hence the sheet of material 10 being movable in a plane parallel to the upper surface. The guide frame is provided with mounts 12 which grip the sheet 10, and also a mount 13 which holds a locating means in the form of a stylus 14. The upper surface of the table is arranged to receive a template 15 shown partially in dotted outline and comprising a sheet of metal in which a pattern of pilot holes has been formed. In this example of the machine, the template has a surface area equal to half that of the sheet of material 10.

First and second hole forming means each in the form of punching heads 16, 17 are mounted on the machine frame. Each of the punching heads 16, 17 comprises a rotatable turret 18, 19 adjacent the periphery of which is mounted a plurality of punches 20 of different shapes and sizes. The punching heads 16, 17 are arranged to punch holes in the sheet 10 in respective hole forming or punching stations 21, 22 which are fixed relative to the table, holes of different shapes and sizes being produced by rotating the turrets so as to move appropriate punches to the punching stations. The punching stations 21, 22 are spaced apart by a distance equal to half the length of the sheet 10 and equal to the length of the template.

Figure 2:
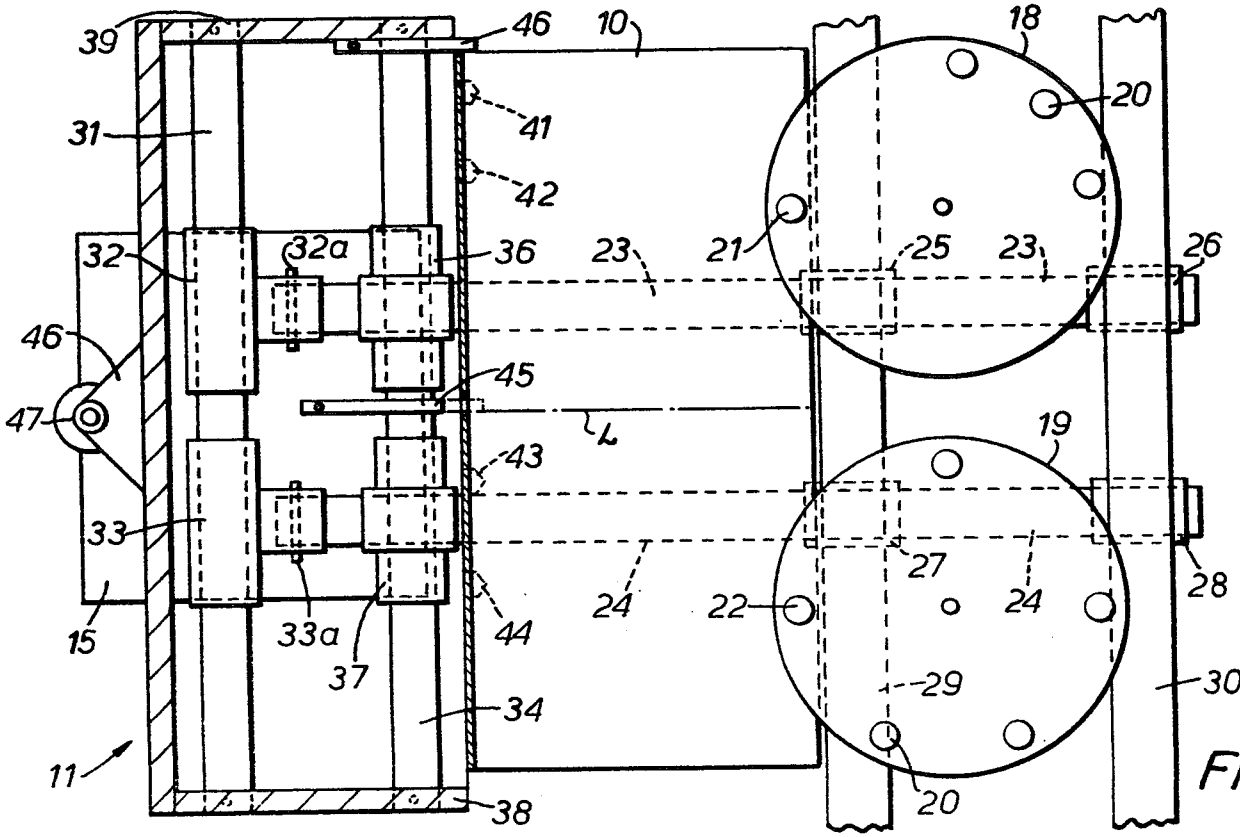
FIG. 2 is a plan view of the machine in more detail showing the guide frame.
Figure 3:
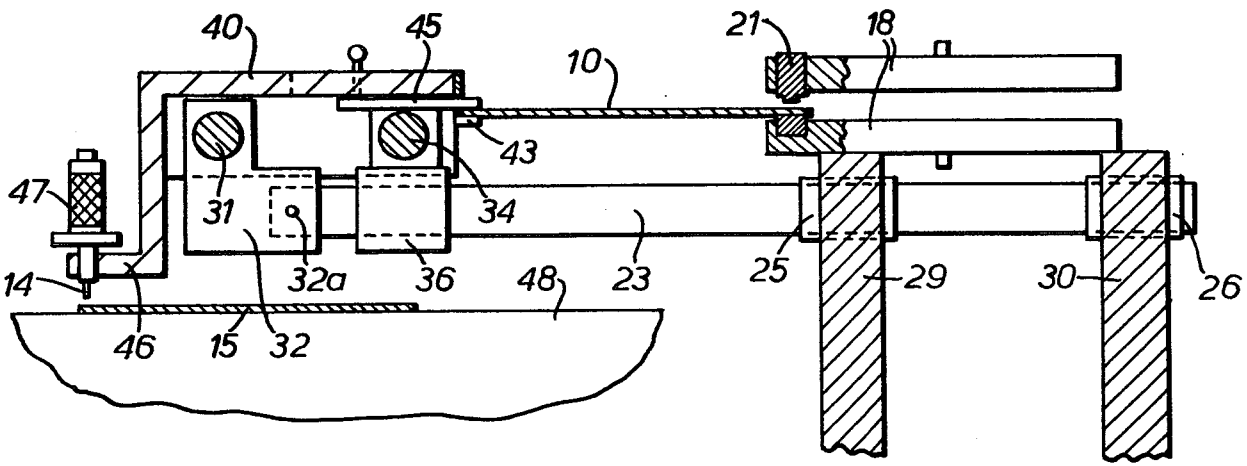
FIG. 3 is an elevational view of the arrangement of FIG. 2.

Referring now to FIGS. 2 and 3, the machine is shown in more practical form and like parts are marked with like reference numerals. The guide frame 11 includes two sets of parallel bars, the sets being mounted orthogonally with respect to each other and so that they can slide relative to each other and the machine frame.

One set comprises bars 23 and 24 which are mounted in linear bearings 25, 26, 27 and 28 that are mounted fast with portions 29 and 30 of the frame of the machine. As can be seen from FIG. 2, the bars are mounted between the turrets 18, 19. A bar 31 of the other set is slidably mounted in T-bearings 32, 33 that are attached by pins 32*a*, 33*a* to ends of the bars 23 and 24. A bar 34 of said other set is slidably mounted in bearings 36, 37 that are themselves slidably mounted on bars 23 and 24. The ends of the bars 31 and 34 are mounted on end plates 38 and 39 which are attached to a base plate 40.

The sheet of material 10 to be punched is attached to the guide frame by holding means comprising four clamps 41 to 44 mounted on the base plate 40 and two datum stops 45, 46 are provided in the base plate for accurately positioning the sheet 10 in the clamps. The datum stops, which are both shown in an extended state, can be manually slid in grooves in the base plate 40 and act as a stop against which the sheet is engaged before the clamps are operated, each datum stop being used to align a different sized sheet in the clamps.

The base plate 40 also includes an extension 46 on which is mounted a handle 47 permitting manual movement of the base plate. The stylus 14 is mounted coaxial with the handle, the handle and stylus both being mounted on the extension 46. Thus, the stylus can be manually swept over holes in the template 15 which is itself mounted fast with the support table which is referenced 48. The axis of the handle 47 and stylus 14 passes between the axes of the bars 23 and 24.

In operation of the punching machine, the template 15 is first mounted fast on the machine frame, and the sheet of material 10 to be punched is mounted in the clamps 41 - 44.

The handle 47 is then moved to align the stylus 14 with a pilot hole in the template. The disc 18 is rotated to align an appropriate punch in the punching station 21, and the punch is then operated to make a hole in the sheet 10. The stylus 14 is then moved sequentially to other pilot holes in the template, and thus by use of selected punches the turret 18, a pattern of holes on the template 15 is mapped on to the portion of the sheet 10 to the left of hatched line L. Similarly, by the use of the punches of the turret 19, a pattern of holes on the template is mapped on to the portion of the sheet to the right of the line L. The template can include more than one pattern of holes so that a different pattern can be mapped on to each of the two portions of the sheet 10. Alternatively, if the same pattern is to be mapped on to each portion, the punching heads can be operated simultaneously with a consequent reduction of manufacturing time. An advantage of the punching machine, when used to punch a sheet of material twice the size of the template, is that the sheet of material does not have to be removed from the guide frame during punching, and hence positional errors of the punched holes are reduced.

By means of the guide frame 11, the sheet 10 can be moved relative to the punching stations 21, 22 in a plane parallel to the template 15, but cannot be rotated in that plane. The bearings 32, 33, 36, 37, whilst permitting the set of bars 23, 24 to slide relative to the set of bars 31, 34, hold the sets in a rigid orthogonal relationship. Also, since the handle is connected to the middle of the base plate 40 between the axes of the bars 23, 24, the torque applied to the base plate is minimised so as to reduce any possible flexing. However, in the event of flexing of the bars, the parallel arrangement of the bars ensures that no rotation of the sheet 10 relative to the template 15 occurs. The bars can move relative to each other in response to a force causing them to flex, the bearings 36 and 37 permitting the movement to occur without the bearings of the arrangement jamming. However, the bars of each set will remain substantially parallel upon flexing. The sheet 10 may be displaced relative to the template 15 due to flexing of the bars, but since the stylus 14 will also be displaced by the flexing, the pattern of pilot holes on the template can always be accurately mapped on to the sheet 10.

To prevent the bars 23, 24 from being moved out of bearings 26, 28, a stop bar (not shown) can be provided connected between the ends of the bars. The stop bar will also tend to hold the bars in parallel.

Whilst the machine has been described above in use with a sheet of material twice the size of the template, the punching machine can also be used, with advantage, to punch holes in larger sheets of material; such larger sheets must, however, be removed and turned around in the guide frame during punching of the pattern(s), but compared with the aforementioned known machine, the number of times that the sheet must be removed to permit all of the sheet area to be punched, is reduced, thereby reducing positional errors of punched holes in the sheet and also reducing manufacturing time. Thus, for example, with a square template and a square sheet of material which has four times the surface area of the template, the sheet will have to be turned around once in the guide frame to permit all of the area of the sheet to be punched. With the aforementioned prior machine, the sheet would have to be turned around three times.

Further punching heads can be included in the machine to permit larger sheets of material to be punched.

If the punching heads 16, 17 are operated sequentially, the punching machine need not require a larger power supply than a machine with a single punching head.

It will be apparent to those skilled in the art that if more than one pattern of holes is included in the template, means can be provided to discriminate between the holes of each pattern. It will also be apparent that means can be provided to align appropriate ones of the punches at the punching stations in accordance with the positions of different ones of the pilot holes engaged by the stylus. For example, the template could be marked with a code next to each pilot hole to indicate to the machine operator the punch on the rotary turret which is to be used. It will also be appreciated that the stylus could be driven by motor means.

If the pattern to be punched is formed on a template which is smaller than the template 15, and it is designed to reproduce the pattern thereon by means of each of the punching heads 16 and 17, then to avoid wastage of the material to be punched, two separate sheets (which are each smaller than half of the sheet 10) can be mounted spaced apart in guide frame 11 so as to be punched by the respective heads 16 and 17, the datum stops 45, 46 being used to provide reference alignment positions for positioning the sheets in the guide frame.

In another modification, the template and stylus could be replaced by numerical control apparatus, the guide frame then being moved by motor means under the control of information recorded for example on punched or magnetic tape. It will thus be appreciated that the template constitutes only one form of a device that includes information as to a pattern of holes to be punched, which is adapted to be received in receiving means in the machine.

What is claimed is:

1. A hole forming machine for producing a pattern of holes in a sheet of given material, comprising (a) a machine frame, (b) at least two spaced hole forming means connected with said frame, each of said hole forming means including (1) a rotary turret;

(2) a plurality of punches mounted on said turret, said turret being rotatable to successively position said punches opposite a hole forming station on said machine frame; and (3) means for operating that one of said punches which is positioned at said hole forming station at a given time;

(c) guide frame means connected with said frame for supporting said sheet for two-dimensional coplanar displacement relative to said hole forming stations, said guide frame means including two sets of orthogonally-arranged slidably connected pairs of parallel spaced bars, one set of said bars being connected with said frame for axial sliding movement, and sheet holding means for mounting the sheet of material on the other set of bars;

(d) a template mounted on said machine frame, said template containing a pattern indicative of the holes to be formed in said sheet by said hole forming means; and (e) a stylus mounted on said guide frame means for cooperation with the template pattern for positioning said sheet at a desired location relative to said hole forming stations, whereby said hole forming means are operable to form on two separate areas of said sheet a two dimensional pattern of holes determined by the pattern on said template.

2. Apparatus as defined in claim 1, wherein the distance between the punching stations equals the corresponding dimension of the template and generally half the corresponding dimension of the workpiece.

3. Apparatus as defined in claim 1, wherein said template pattern is provided with a characteristic code indicative of which punch on each rotary turret is to be positioned at the associated hole forming station.

4. Apparatus as defined in claim 1, wherein said one set of bars extends between said turrets in a direction normal to the line which extends between said hole forming stations.

5. Apparatus as defined in claim 4, wherein said stylus is arranged centrally between said one set of bars.

6. Apparatus as defined in claim 1, wherein the bars of said one set of bars are each slidably mounted in a pair of aligned spaced bearings that are fixedly connected with said machine frame, respectively.

7. Apparatus as defined in claim 6, and further including two pairs of third bearing means mounted on the bars of said first set of bars, respectively, the second set of bars being slidably mounted in said third bearing means for axial sliding movement in a direction normal to the direction of axial displacement of said first set of bars.

* * * * *